US005377989A

United States Patent [19]

Machin

[11] Patent Number: 5,377,989

[45] Date of Patent: Jan. 3, 1995

[54] GOLF BALLS WITH ISODIAMETRICAL DIMPLES

[75] Inventor: Brian F. Machin, Wakefield, England

[73] Assignee: Dunlop Limited, London, England

[21] Appl. No.: 106,137

[22] Filed: Aug. 13, 1993

Related U.S. Application Data

[63] Continuation-in-part of Ser. No. 892,431, Jun. 1, 1992, abandoned, which is a continuation of Ser. No. 657,506, Feb. 19, 1991, abandoned.

[51] Int. Cl.[6] ..... A63B 37/14

[52] U.S. Cl. ..... 273/232; 40/327

[58] Field of Search ..... 273/232, 220, 235 R, 273/233, 62; D21/205; 40/327

[56] References Cited

U.S. PATENT DOCUMENTS

| | | | |
|---|---|---|---|
| 1,681,167 | 5/1928 | Beldam | 273/232 |
| 2,728,576 | 12/1955 | Martin et al. | 273/232 |
| 4,869,512 | 9/1989 | Nomura et al. | 273/232 |

FOREIGN PATENT DOCUMENTS

| | | | |
|---|---|---|---|
| 1005480 | 2/1977 | Canada | 273/232 |
| 377354 | 7/1932 | United Kingdom | 273/232 |

*Primary Examiner*—George J. Marlo
*Attorney, Agent, or Firm*—Lorusso & Loud

[57] ABSTRACT

In a golf ball, non-circular isodiametrical dimples provide increased efficiency of coverage of the surface of a golf ball (in comparison with the conventional circular dimples). Additionally, the aerodynamic properties of the ball are improved.

The dimples have the shape of a regular isodiametrical figure with an odd number of curved sides and arcuate apices. The number of sides of the isodiametrical figure conveniently is from three to nine.

13 Claims, 14 Drawing Sheets

GOLF BALLS WITH ISODIAMETRICAL DIMPLES

This is a continuation-in-part of copending application(s) Ser. No. 07/892,431 filed on Jun. 1, 1992 which is a File Wrapper continuation of U.S. Ser. No. 07/657506 filed Feb. 19, 1991 the content of which are incorporated herein by reference and both of which applicatios are abandoned.

This invention relates to golf balls with isodiametrical dimples.

It has been known for many years to provide a golf ball with a plurality (multiplicity) of dimples in order to optimise the aerodynamic properties of the ball. Such dimples usually are circular in plan view although polygonal shapes have been proposed, such as triangular, rectangular, pentagonal and hexagonal shapes.

The rules laid down by the governing bodies of the game require that golf balls should behave relatively uniformly from an aerodynamic point of view while the requirements of the golfer also place great emphasis on increased distance to be achieved by reducing the drag force on the ball during flight. Golf ball dimple patterns are of the most profound importance in meeting these requirements both in terms of dimple shape and dimple pattern arrangement.

The use of circular dimples imposes undesirable constraints on surface coverage and on maintaining the optimum relationship between adjacent dimples for reducing the drag force acting on the ball to a minimum, but constant diameter is a desirable feature in creating uniformity in aerodynamic behaviour.

It has now been found that dimples which are non-circular but isodiametrical in plan view can not only provide far greater efficiency of surface coverage but also result in improved aerodynamic properties.

Accordingly, the present invention provides a golf ball having in its spherical surface a multiplicity of dimples, in which each dimple has the shape, when viewed from above, of a regular isodiametrical figure having an odd number of sides and arcuate apices.

Typical examples of suitable non-circle isodiametrical figures for the dimple shapes are three-sided, five-sided, seven-sided, nine-sided, eleven-sided and thirteen-sided figures. Isodiametrical figures having a higher number of sides could be employed although as the number of sides is increased above about thirteen the dimple shapes would bear an increasing resemblance to a circle in appearance.

The sides of an isodiametrical figure have equal curvature and the apices at the junctures of adjacent sides are arcuate. The sides and arcuate apices may be created by arcs of circles centred at the apices of an imaginary corresponding regular polygon (for example, a three-sided isodiametrical figure corresponding to an equilateral triangle, a five-sided isodiametrical figure corresponding to a regular pentagon, etc.).

The golf ball surface may have iodiametrical dimples all of which have the same number of sides or may comprise isodiametrical dimples having two or more different numbers of sides.

The isodiametrical dimples in the golf ball surface may be all of the same diametrical size or may be of two or more diametrical sizes.

Preferably, the dimples are arranged on the spherical surface of the ball in a uniform repeating pattern.

The pattern conveniently may be defined by projecting the edges of a regular polyhedron on to the spherical surface of the ball. Examples of regular polyhedra for the dimple pattern include the cube, the octahedron, the dodecahedron, the icosahedron and the icosidodecahedron.

The present invention will be illustrated, merely by way of example, in the following description and with reference to the accompanying drawings, in which:

FIGS. 1 to 4 show, diagrammatically, examples of isodiametrical dimple shapes in accordance with the invention and means for deriving the shapes geometrically.

in particular:

Figure 5:
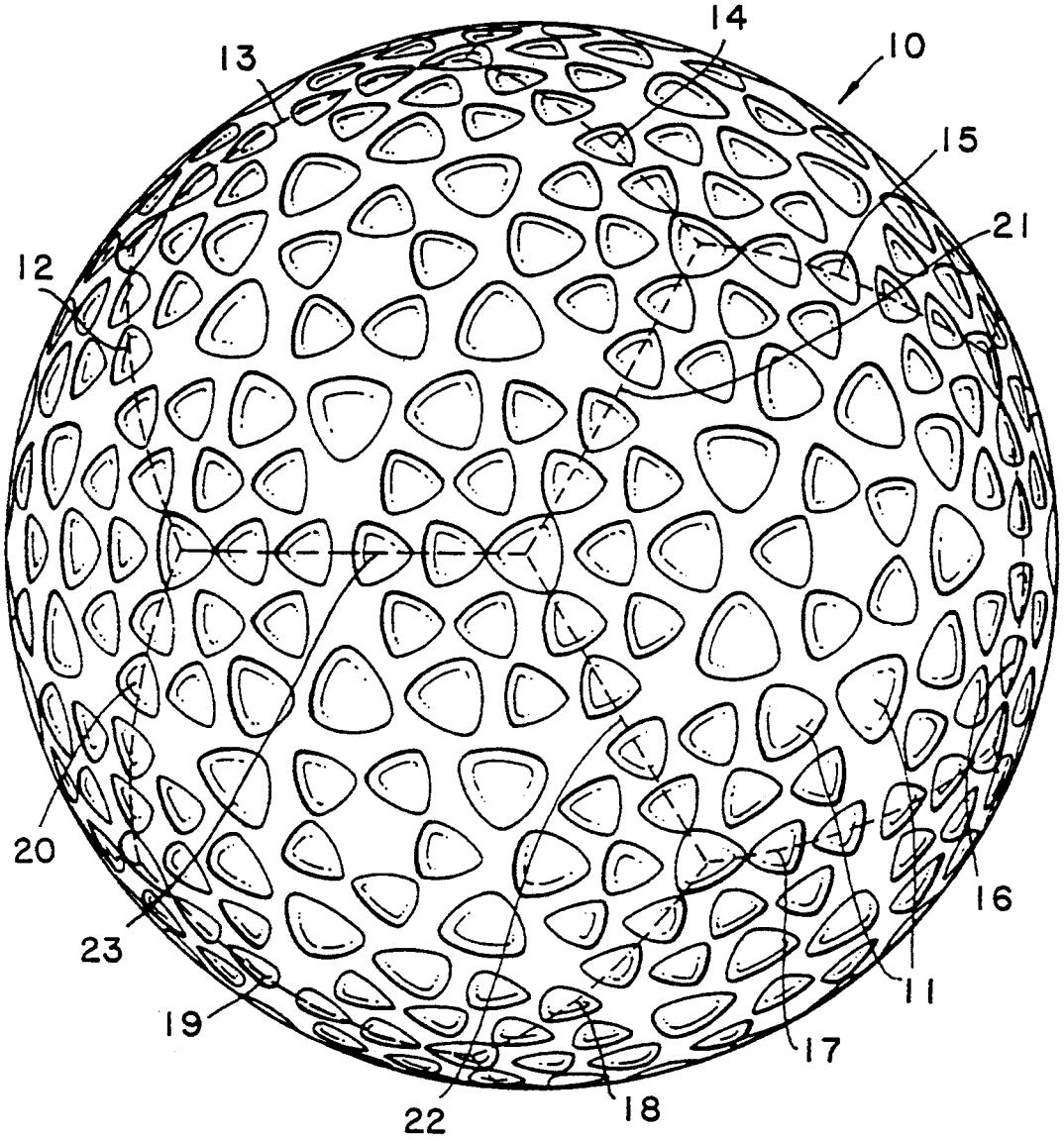
FIGS. 5 to 14 are schematic views of golf balls having on the spherical golf ball surface a multiplicity of isodiametrical dimples arranged in repeating patterns defined by regular polyhedra.
Figure 6:
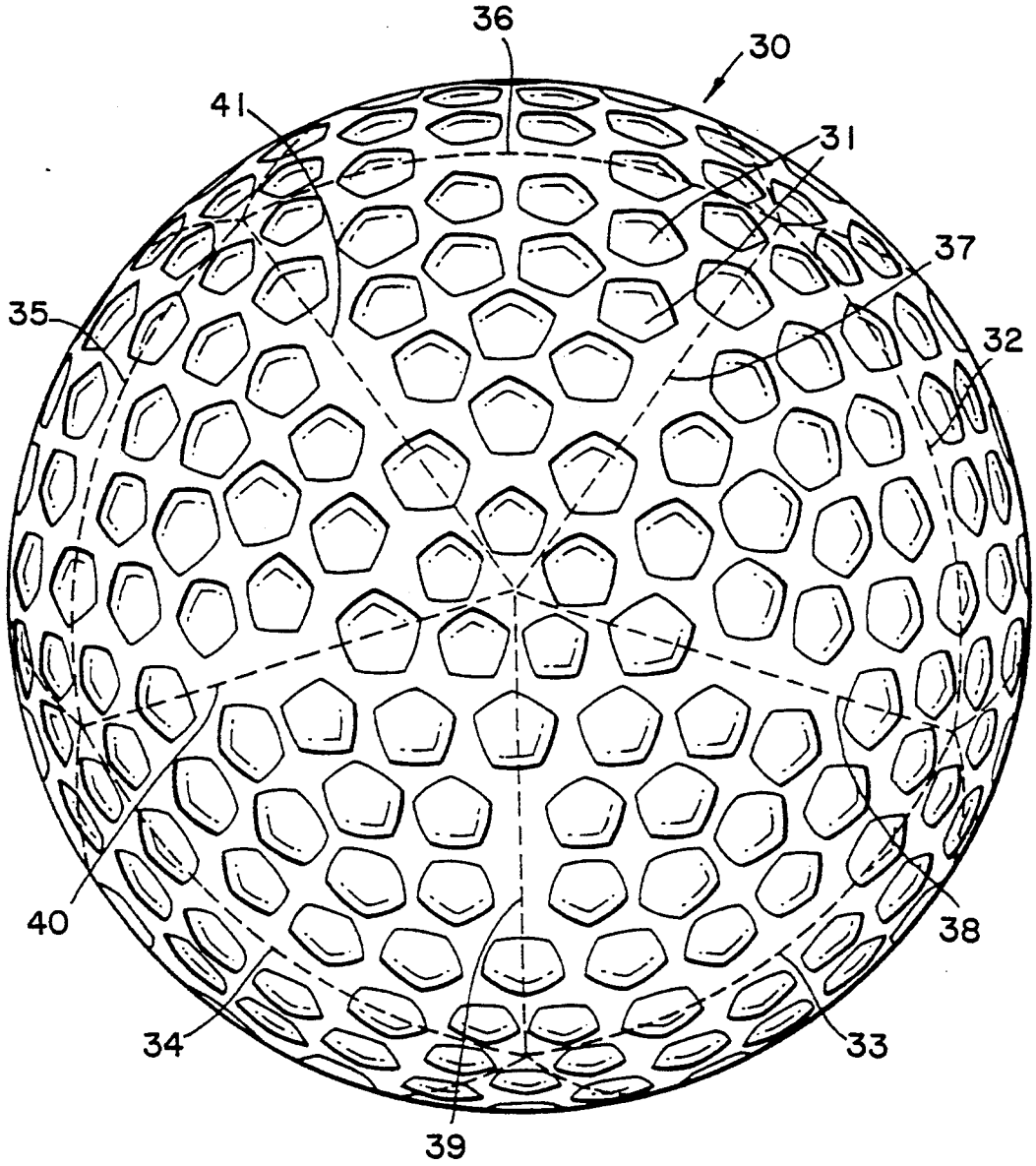
Figure 7:
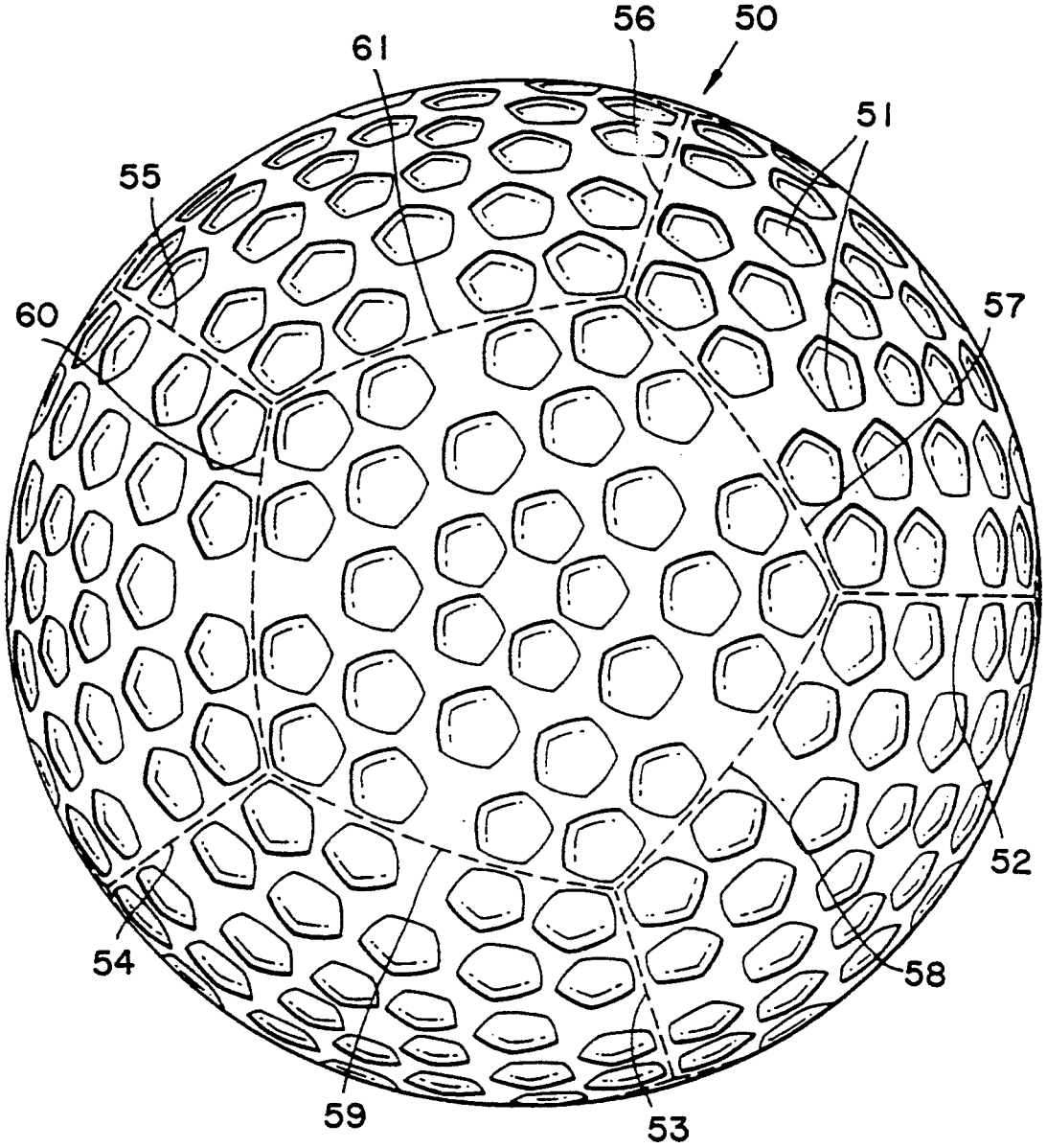
Figure 8:
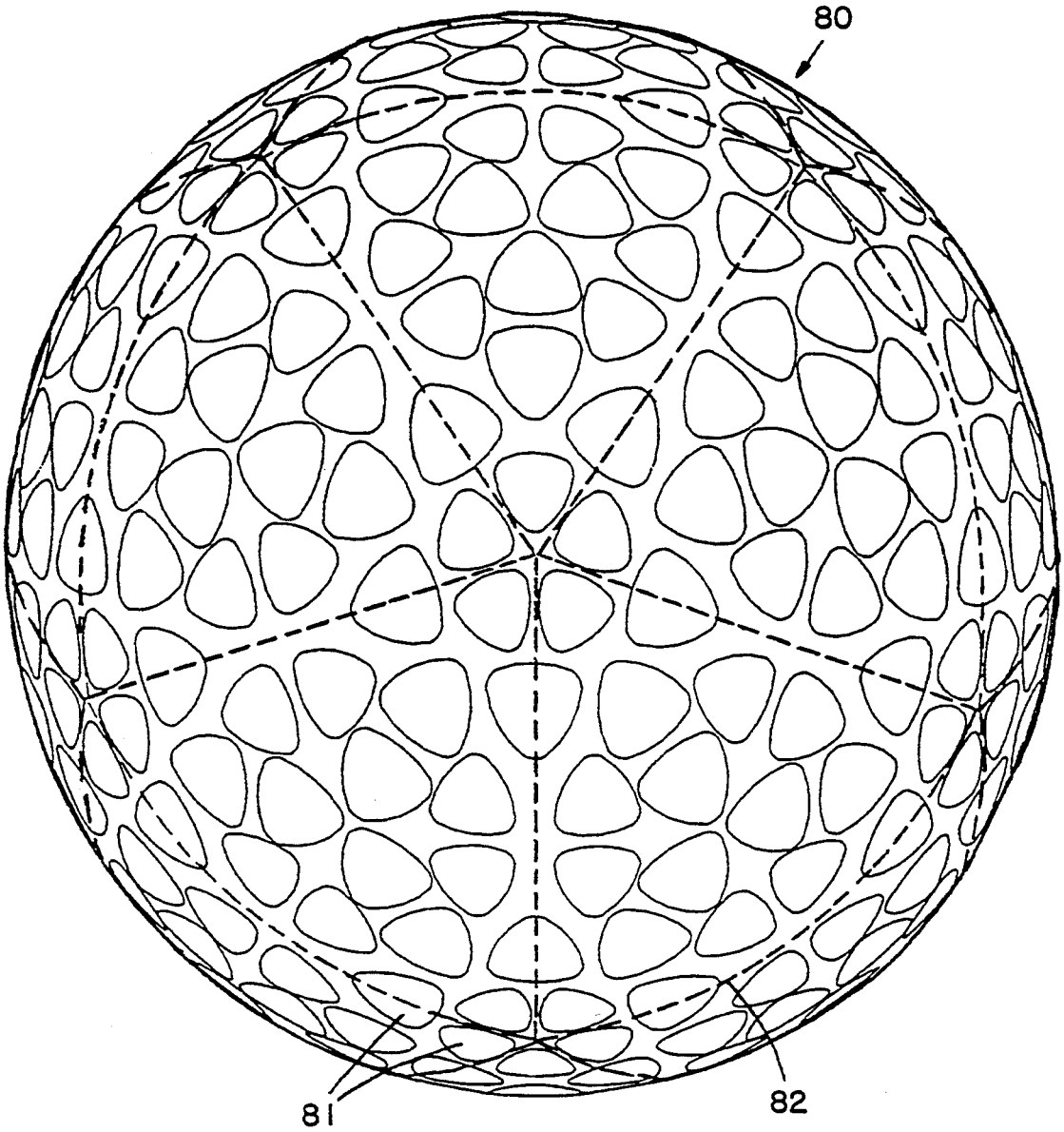
Figure 9:
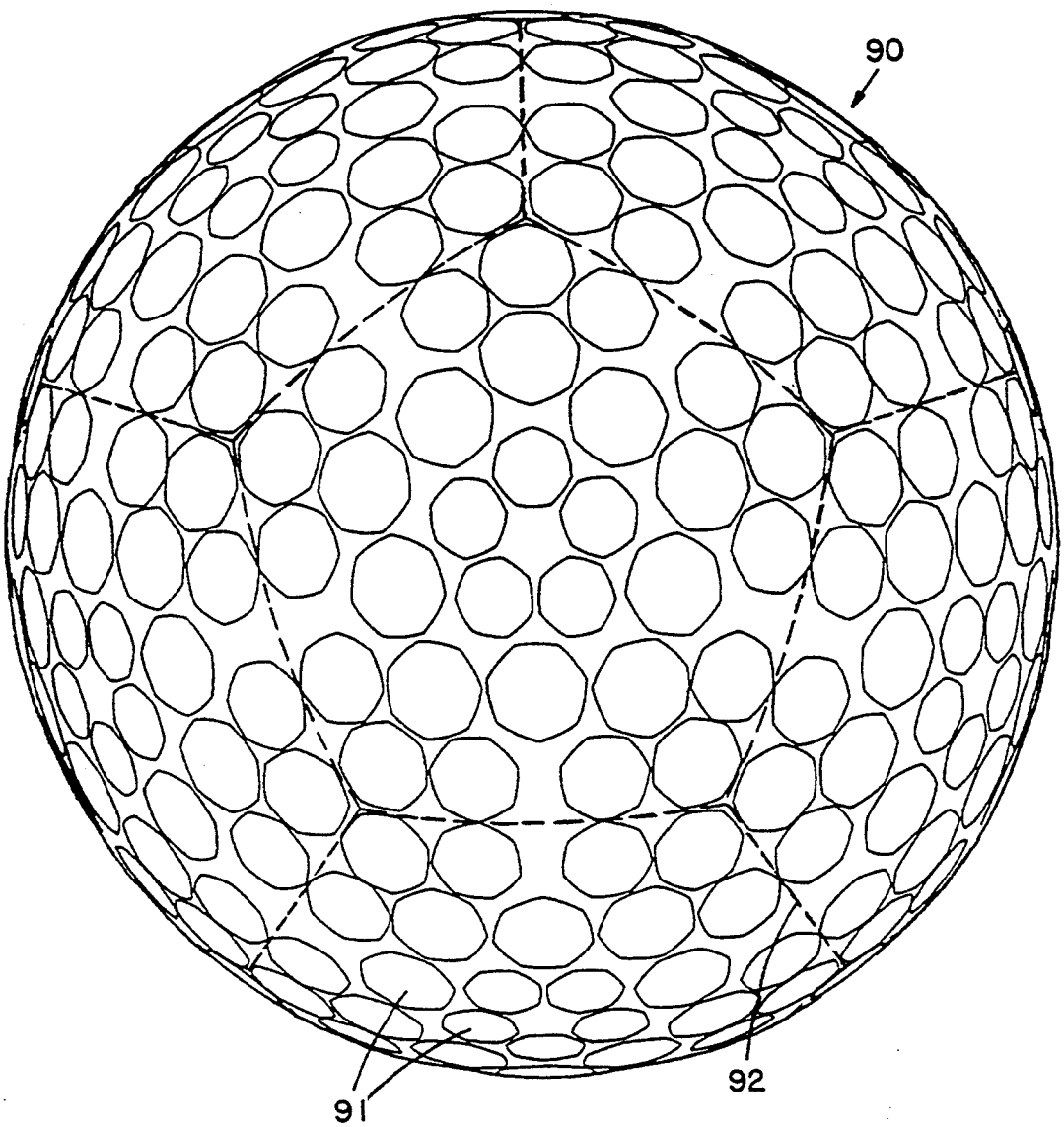
Figure 10:
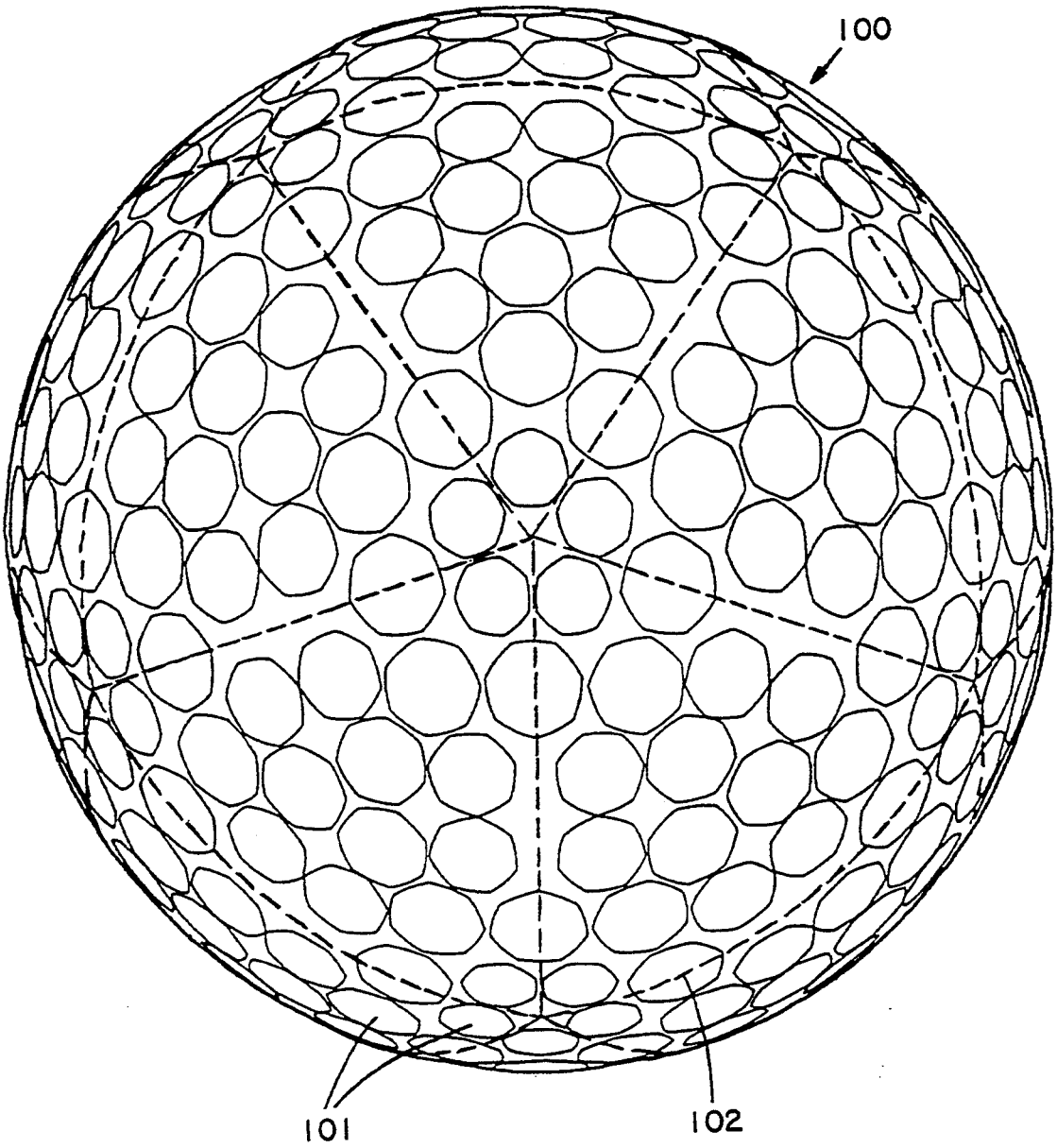
Figure 11:
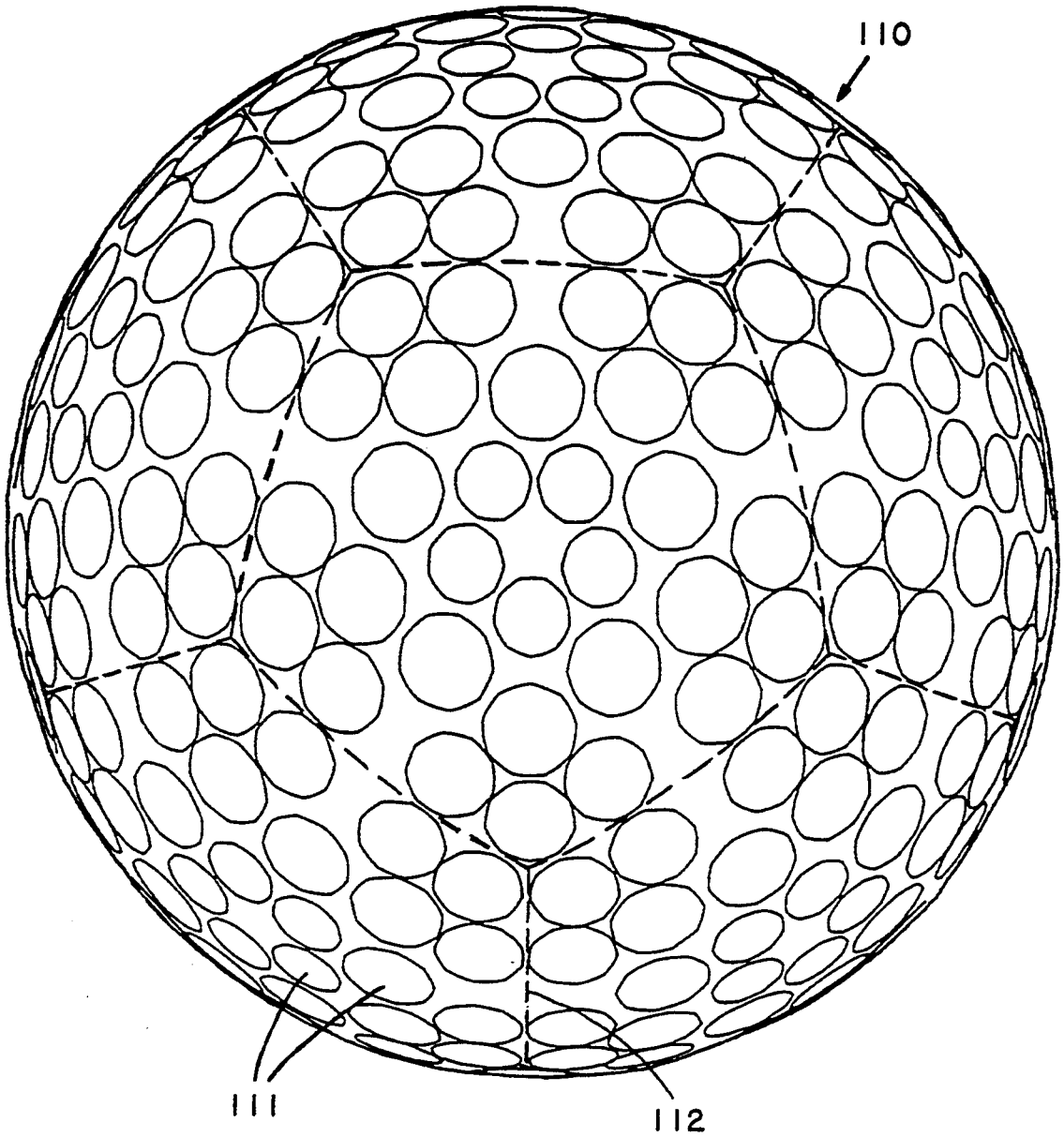
Figure 12:
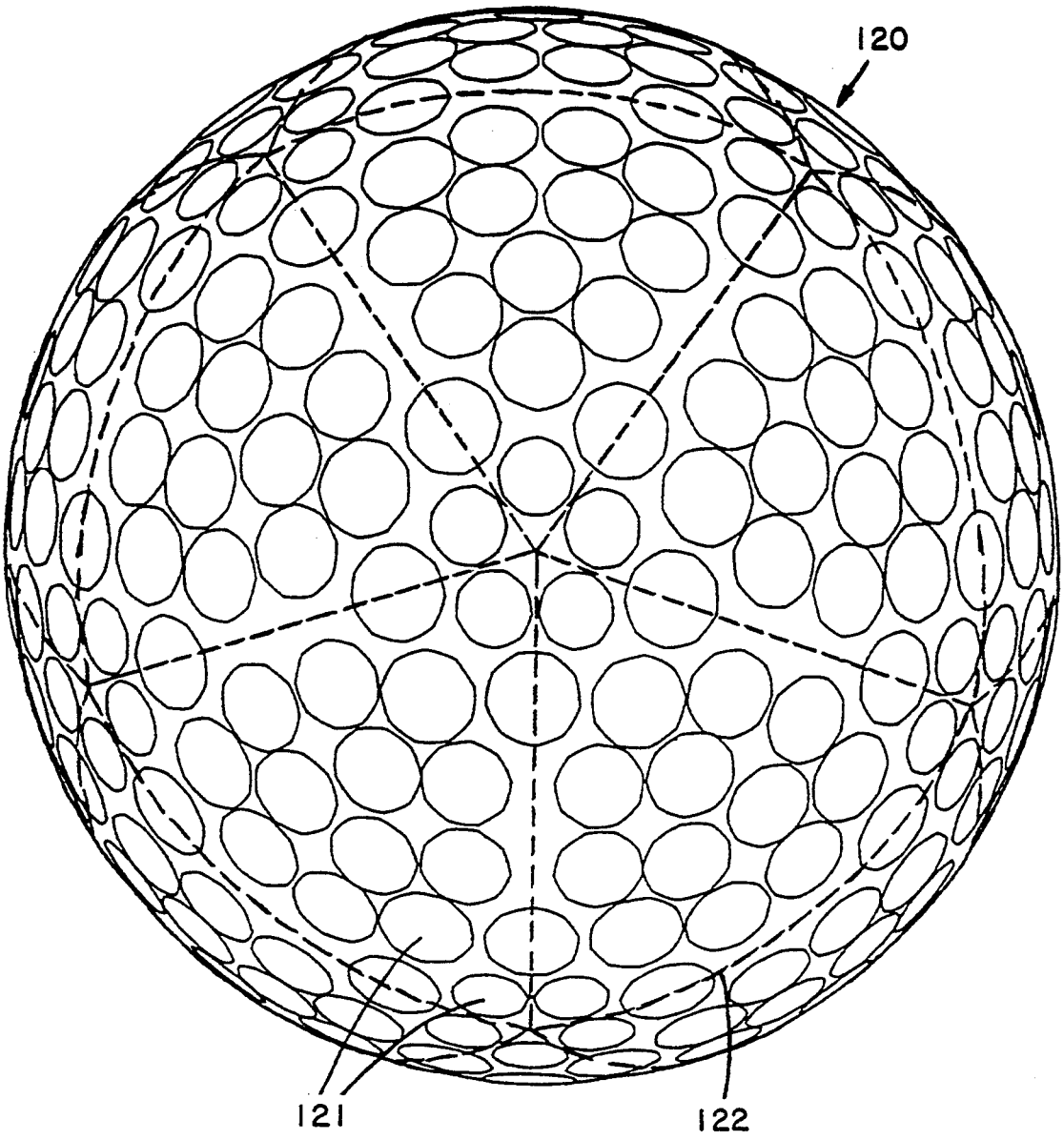
Figure 13:
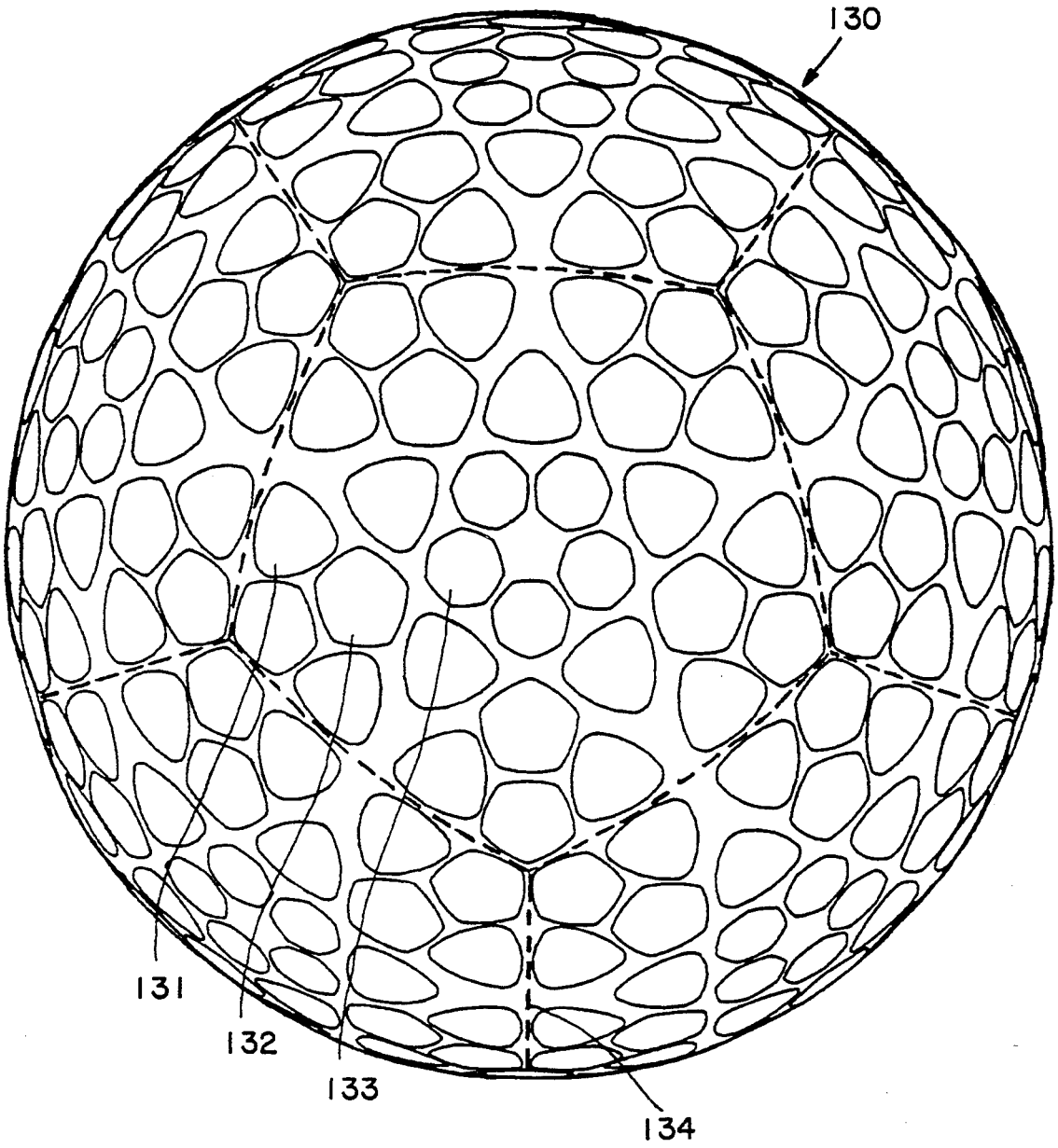
Figure 14:
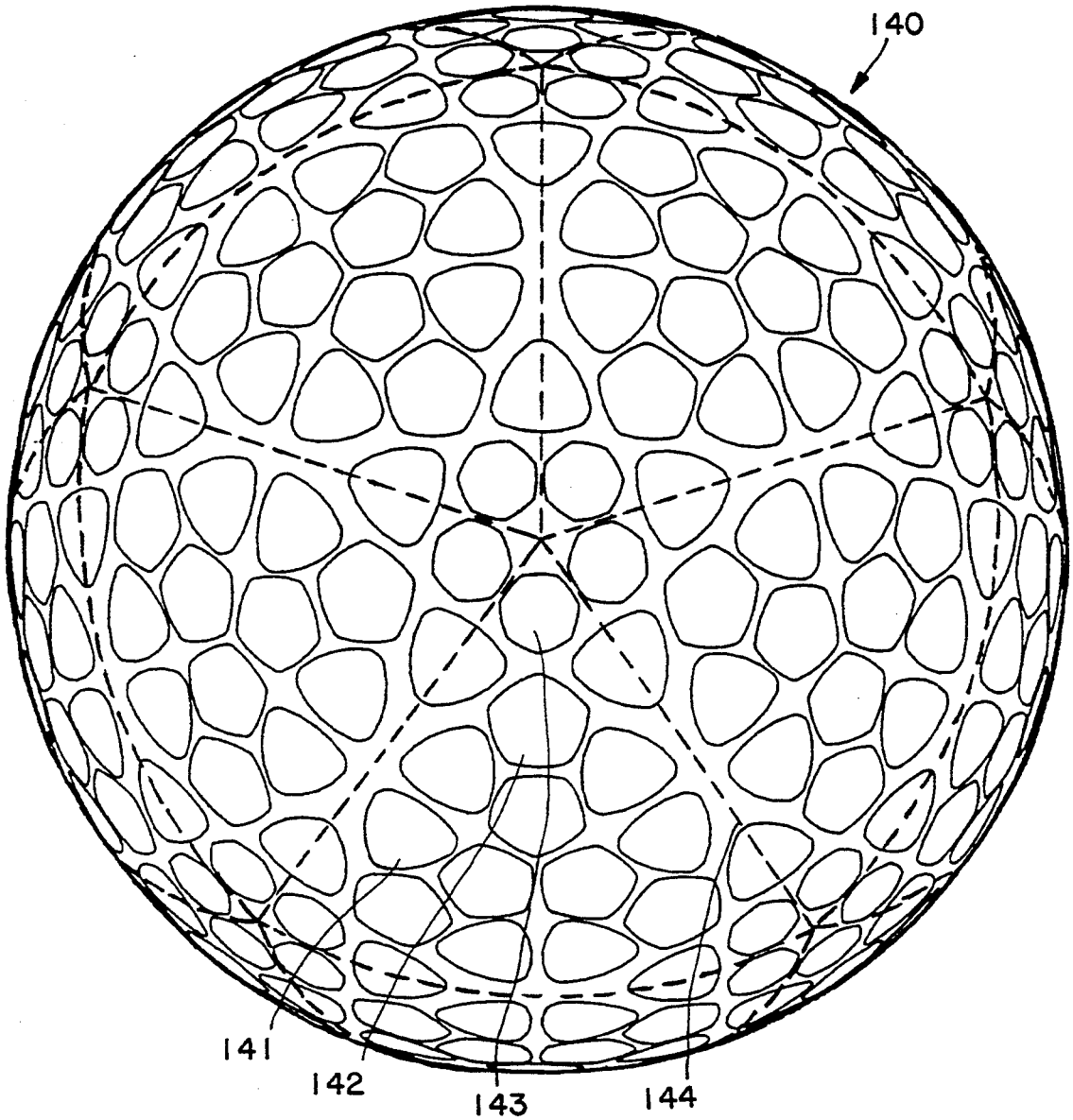

In particular:

FIG. 5 shows three-sided isodiametrical dimples arranged in a dodecahedral pattern;

FIG. 6 shows five-sided isodiametrical dimples arranged in an icosahedral pattern;

FIG. 7 shows five-sided isodiametrical dimples arranged in a dodecahedral pattern;

FIG. 8 shows three-sided isodiametrical dimples arranged in an icosahedral pattern;

FIG. 9 shows seven-sided isodiametrical dimples arranged in a dodecahedral pattern;

FIG. 10 shows seven-sided isodiametrical dimples arranged in an icosahedral pattern;

FIG. 11 shows nine-sided isodiametrical dimples arranged in a dodecahedral pattern;

FIG. 12 shows nine-sided isodiametrical dimples arranged in an icosahedral pattern;

FIG. 13 shows an assembly of three-sided, five-sided and seven-sided isodiametrical dimples arranged in a dodecahedral pattern;

FIG. 14 shows an assembly of three-sided, five-sided sided and seven-sided isodiametrical dimples arranged in an icosahedral pattern.

Figure 1:
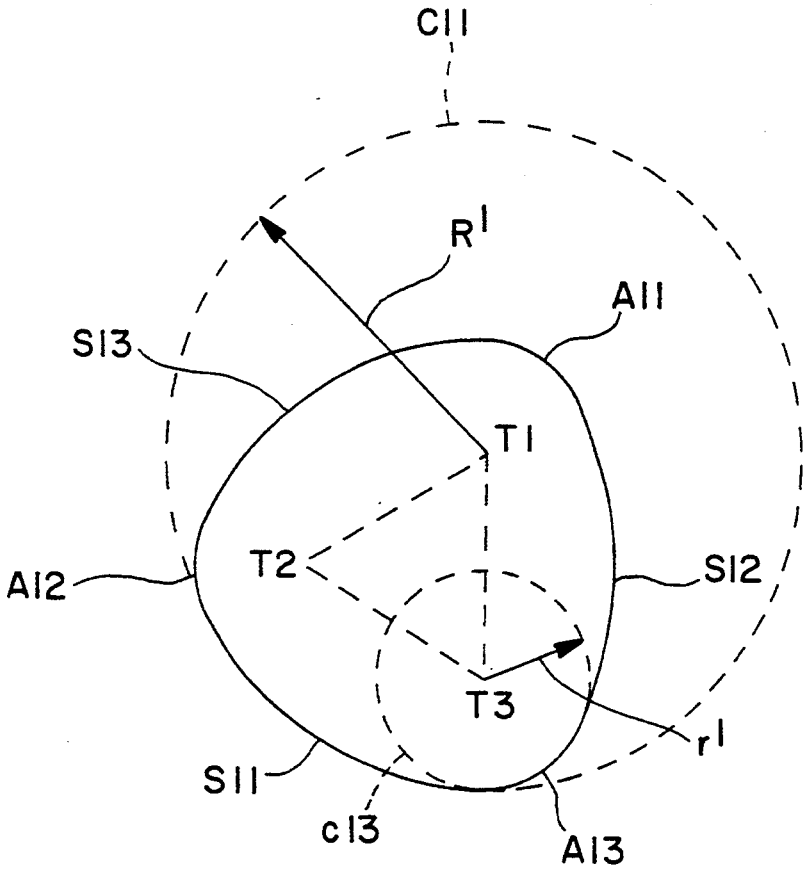
FIG. 1 illustrates a three-sided isodiametrical shape.

In FIG. 1 there is shown an isodiametrical dimple shape having three curved sides S11, S12, S13 and arcuate apices A11, A12, A13 at the junctures of adjacent sides. The shape may be derived geometrically from a nominal equilateral triangle with apices T1, T2, T3, as follows. A circle C11 is projected with its centre at apex T1 and having a radius $R^1$ which is greater than the largest internal dimension of the nominal triangle. Two further circles are then projected having the same radius $R^1$ but with centres at apex T2 and apex T3 respectively. Curved side S11 is provided by an arc of the circle C11 and, similarly, curved sides S12 and S13 respectively are provided by arcs of the circles with centres at T2 and T3. A minor circle c13 is then projected with its centre at apex T3 and having a radius $r^1$ such that the circle c13 is tangential to both the circle C11 and the circle of radius $R^1$ with its centre at apex T2. The arc of minor circle c13 between the tangential points provides the arcuate apex A13 at the juncture of the curved sides S11 and S12. Two further minor circles are then projected having the same radius $r^1$ but with centres at the triangle apices T1 and T2, thereby providing, analogously to circle c13, the arcuate apices A11 and A12 respectively.

Figure 2:
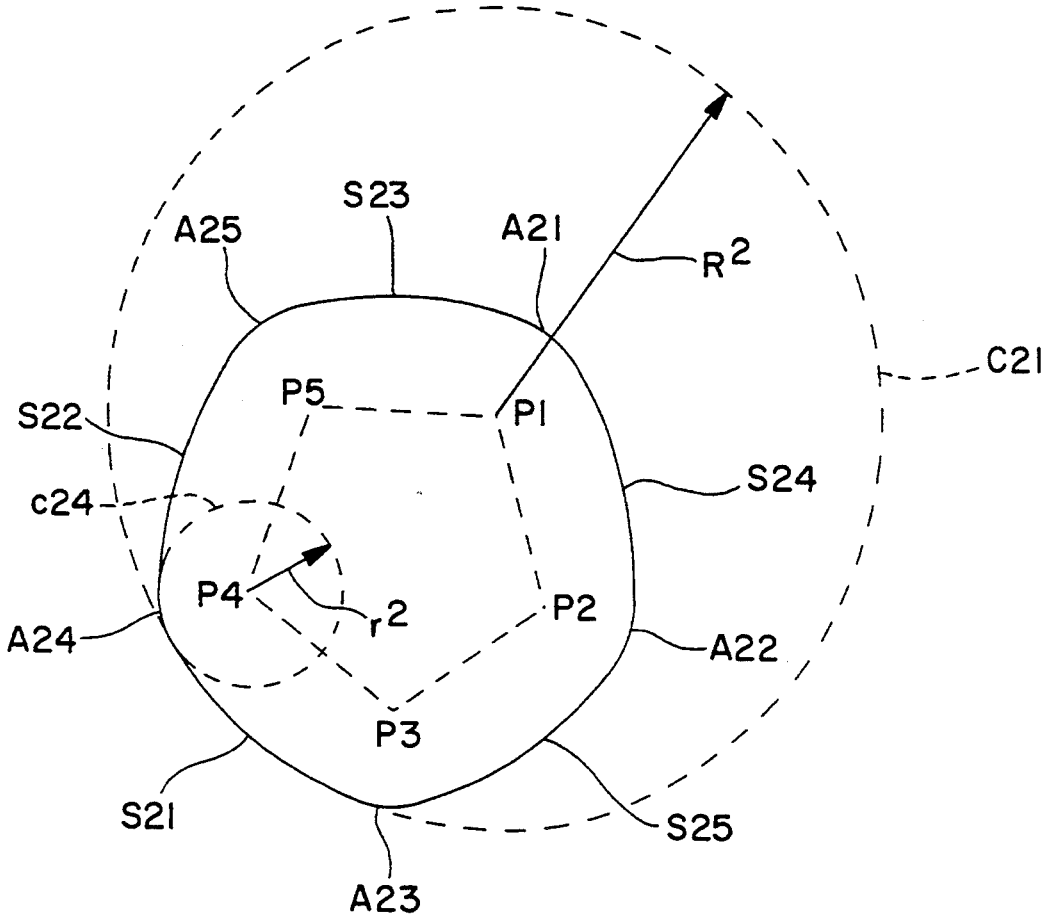
FIG. 2 illustrates a five-sided isodiametrical shape.

In FIG. 2 there is shown an isodiametrical dimple shape having five curved sides S21, S22, S23, S24, S25 and arcuate apices A21, A22, A23, A24, A25 at the junctures of adjacent sides. The shape may be derived geometrically from a nominal regular pentagon with apices P1 to P5, analogously to the procedure described with reference to FIG. 1, as follows. A circle C21 is projected with its centre at apex P1 and having a radius $R^2$ which is greater than the largest internal dimension of the nominal pentagon, and four further circles are projected having the same radius $R^2$ but with centres at apices P2 to P5 respectively. Curved side S21 is provided by an arc of the circle C21, and curved sides S22 to S25 are provided by arcs of the circles with centres at P2 to P5 respectively. A minor circle c24 is projected with its centre at apex P4 and having a radius $r^2$ such that the circle c24 is tangential to both the circle C21 and the circle of radius $R^2$ with its centre at apex P2. The arc of minor circle c24 between the tangential points provides the arcuate apex A24 at the juncture of the curved sides S21 and S22. Four further minor circles are projected having the same radius $r^2$ but with centres at the pentagon apices P5 P1 P2 and P3, thereby providing the arcuate apices A25, A21, A22 and A23 respectively.

Figure 3:
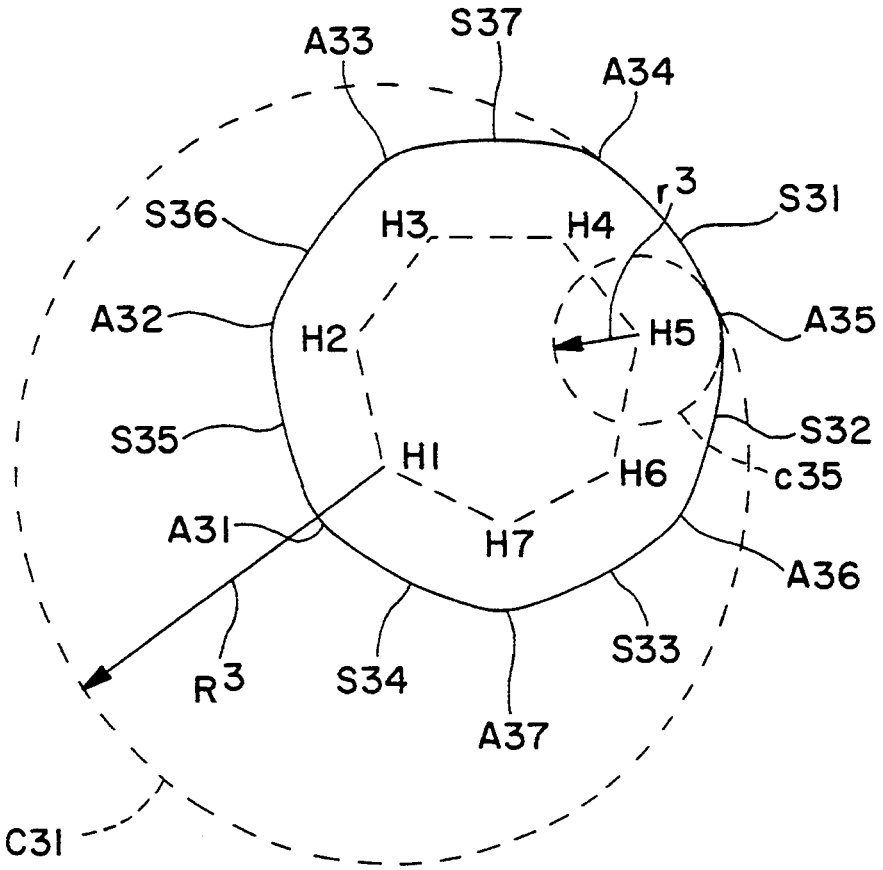
FIG. 3 illustrates a seven-sided isodiametrical shape.

In FIG. 3 there is shown an isodiametrical dimple shape having seven curved sides S31, S32, S33, S34, S35 S36 S37 and arcuate apices A31, A32, A33, A34, A35 A36 A37 at the junctures of adjacent sides The shape may be derived geometrically from a nominal regular heptagon with apices H1 to H7, analogously to the procedure described with reference to FIG. 1 or 2. In this analogous procedure, with reference to FIG. 3, C31 represents a projected circle with its centre at apex H1 and having the radius $R_3$, an arc of which provides the curved side S31, and c35 represents a projected minor circle with its centre at apex H5 and having the radius $r^3$, the tangential arc of which provides the arcuate apex A35.

Figure 4:
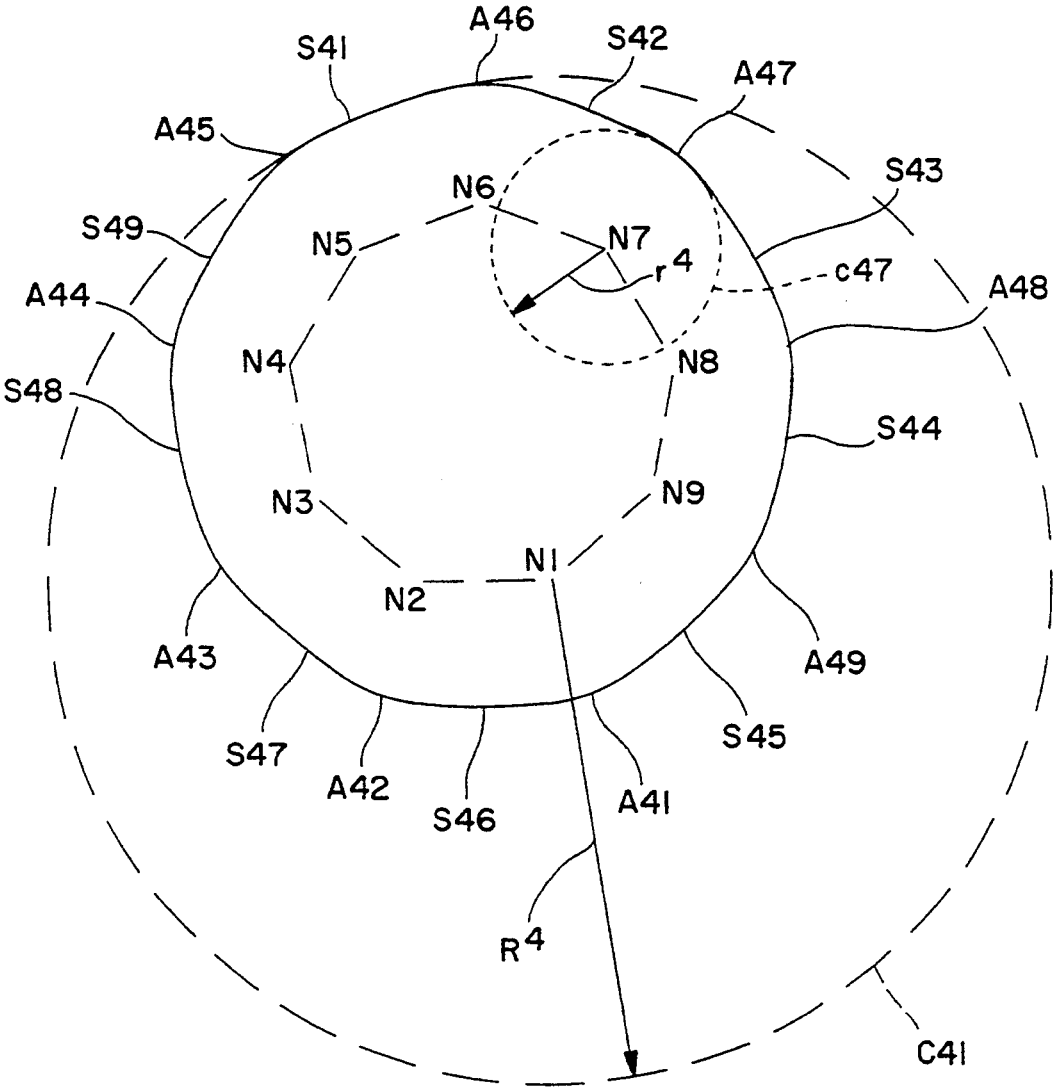
FIG. 4 illustrates a nine-sided isodiametrical shape.

In FIG. 4 there is shown an isodiametrical dimple shape having nine curved sides S41 to S49 and arcuate apices A41 to A49 at the junctures of adjacent sides. The shape may be derived geometrically from a nominal regular nonagon with apices N1 to N9, analogously to the procedure described with reference to FIG. 1 or 2. In this analogous procedure, with reference to FIG. 4, C41 represents a projected circle with its centre at apex N1 and having the radius $R^4$, an arc of which provides the curved side S41, and c47 represents a projected minor circle with its centre at apex N7 and having the radius $r^4$ the tangential arc of which provides the arcuate apex A47.

Isodiametrical dimple shapes having more than nine curved sides may be derived geometrically from the corresponding nominal regular polygon by an analogous procedure.

In FIG. 5, a golf ball 10 is provided with a multiplicity of isodiametrical dimples 11, each having three equal curved sides joined by arcuate apices. The dimple pattern is indicated by broken lines 12 to 23 inclusive, representing the projection of the edges of a regular dodecahedron on to the spherical surface of the ball.

In FIG. 6, a golf ball 30 is provided with a multiplicity of isodiametrical dimples 31, each having five equal curved sides joined by arcuate apices. The dimple pattern is indicated by broken lines 32 to 41 inclusive, representing the projection of the edges of a regular icosahedron on to the spherical surface of the ball.

In FIG. 7, a golf ball 50 is provided with a multiplicity of isodiametrical dimples 51, each having Five equal curved sides joined by arcuate apices. The dimple pattern is indicated by broken lines 52 to 61 inclusive, representing the projection of the edges of a regular dodecahedron on to the spherical surface of the ball.

With reference to FIGS. 8 to 14, for simplicity only one numeral has been used to denote the pattern-defining broken lines representing the projection of the edges of a regular polyhedron on to the spherical surface of the ball.

In FIG. 8, a golf ball 80 is provided with a multiplicity of isodiametrical dimples 81, each having three equal curved sides joined by arcuate apices, arranged in an icosahedral pattern as indicated by broken lines 82.

In FIG. 9, a golf ball 90 is provided with a multiplicity of isodiametrical dimples 91, each having seven equal curved sides joined by arcuate apices, arranged in a dodecahedral pattern as indicated by broken lines 92.

In FIG. 10, a golf ball 100 is provided with a multiplicity of isodiametrical dimples 101, each having seven equal curved sides joined by arcuate apices, arranged in an icosahedral pattern as indicated by broken lines 102.

In FIG. 11, a golf ball 110 is provided with a multiplicity of isodiametrical dimples 111, each having nine equal curved sides joined by arcuate apices, arranged in a dodecahedral pattern as indicated by broken lines 112.

In FIG. 12, a golf ball 120 is provided with a multiplicity of isodiametrical dimples 121, each having nine equal curved sides joined by arcuate apices, arranged in an icosahedral pattern as indicated by broken lines 122.

In FIG. 13, a golf ball 130 is provided with a multiplicity of isodiametrical dimples of three different kinds, namely: three-sided dimples 131, five-sided dimples 132 and seven-sided dimples 133. Each dimple has equal curved sides joined by arcuate apices. The dimples are arranged in a dodecahedral pattern as indicated by broken lines 134.

FIG. 14, a golf ball 140 is provided with a multiplicity of isodiametrical dimples of three different kinds, namely: three-sided dimples 141, five-sided dimples 142 and seven-sided dimples 143. Each dimple has equal curved sides joined by arcuate apices. The dimples are arranged in an icosahedral pattern as indicated by broken lines 144.

It is to be understood that in FIGS. 5 to 14 the isodiametrical dimples have curved sides and arcuate apices as are indicated more clearly in FIGS. 1 to 4.

It is to be understood also that the embodiments shown in the drawings are solely by way of example and that there is a multitude of other embodiments falling within the invention as defined and described herein. For instance, a golf ball in accordance with the invention may well have isodiametrical dimples with more than nine curved sides, and/or may well have dimples arranged in a variety of patterns apart from dodecahedral and icosahedral patterns. Furthermore it is to be understood that the isodiametrical shapes may be produced by means alternative to the geometrical procedure described with reference to FIGS. 1 to 4.

I claim:

1. A golf ball having a spherical surface and in said surface a multiplicity of dimples arranged in a repeating pattern over the entire surface of the ball and each of which has the shape, as viewed from above, of a regular isodiametrical figure with an odd number of curved sides and arcuate apices formed at junctures of adjacent sides of said isodiametrical figure.

2. The golf ball of claim 1 wherein said dimples are all of the same diametrical size.

3. The golf ball of claim 1 wherein said dimples are of more than one diametrical size.

4. The golf ball of claim 1 wherein said dimples all have the same number of said curved sides.

5. The golf ball of claim 1 wherein said dimples comprise dimples having at least two different numbers of said curved sides.

6. The golf ball of claim 1 wherein said dimples comprise dimples the isodiametrical figure of which has three sides.

7. The golf ball of claim 1 wherein said dimples comprise dimples the isodiametrical figure of which has five sides.

8. The golf ball of claim 1 wherein said dimples comprise dimples the isodiametrical figure of which has seven sides.

9. The golf ball of claim 1 wherein said dimples comprise dimples the isodiametrical figure of which has nine sides.

10. The golf ball of claim 1 wherein said dimples are arranged on said spherical surface in a uniform repeating pattern, said pattern being defined by projecting on to said spherical surface the edges of a regular polyhedron.

11. The golf ball of claim 10 wherein said regular polyhedron is one selected from the group consisting of cubes, regular octahedra, regular dodecahedra, regular icosahedra and regular icosi-dodecahedra.

12. The golf ball of claim 10 wherein said regular polyhedron is a dodecahedron.

13. The golf ball of claim 10 wherein said regular polyhedron is an icosahedron.

* * * * *